US011559910B2

(12) United States Patent
Shuman

(10) Patent No.: US 11,559,910 B2
(45) Date of Patent: Jan. 24, 2023

(54) SCISSORS WITH REMOVABLE FEATHER RAZOR

(71) Applicant: Kourtney Shuman, Bemus Point, NY (US)

(72) Inventor: Kourtney Shuman, Bemus Point, NY (US)

( * ) Notice: Subject to any disclaimer, the term of this patent is extended or adjusted under 35 U.S.C. 154(b) by 0 days.

(21) Appl. No.: 16/911,588

(22) Filed: Jun. 25, 2020

(65) Prior Publication Data

US 2021/0402628 A1 Dec. 30, 2021

(51) Int. Cl.

| | |
|---|---|
| ***B26B 13/24*** | (2006.01) |
| ***B26B 13/20*** | (2006.01) |
| ***B26B 21/12*** | (2006.01) |
| ***B26B 21/40*** | (2006.01) |

(52) U.S. Cl.

CPC ..... *B26B 13/24* (2013.01); *B26B 13/20* (2013.01); *B26B 21/12* (2013.01); *B26B 21/4012* (2013.01)

(58) Field of Classification Search

CPC ..... B26B 13/20; B26B 13/24; B26B 21/12
See application file for complete search history.

(56) References Cited

U.S. PATENT DOCUMENTS 598,593 A * 2/1898 Christensen et al. ... B26B 13/24 7/136
681,740 A * 9/1901 Sansone ..... B26B 13/24 7/136
1,115,104 A * 10/1914 Prikla ..... B26B 13/24 7/136
1,363,600 A 12/1920 Johnson
2,057,547 A 10/1936 Tring
2,195,353 A 3/1940 Atchison
2,382,281 A 8/1945 Amis
2,593,574 A * 4/1952 LaCrosse ..... B26B 13/24 30/30
2,603,863 A 7/1952 Maggio
2,719,357 A * 10/1955 Laverty ..... B26B 13/24 30/142
2,939,213 A 6/1960 Daniel
(Continued)

FOREIGN PATENT DOCUMENTS

CH 610 541 * 4/1979 ..... B26B 13/24
GB 166062 A 7/1921
(Continued)

*Primary Examiner* — Clark F Dexter
(74) *Attorney, Agent, or Firm* — Simpson & Simpson, PLLC

(57) ABSTRACT

A hair cutting scissors/razor device, including a static blade member and a dynamic blade member, operatively arranged to pivot relative to one another, the static blade member having a blade portion, the blade portion having a tip at a first end and a handle portion at a second end, wherein the blade portion has a cutting edge and a back edge and the handle portion has a static neck portion and a static finger ring, the static blade member also having an aperture to accommodate a tension screw, the aperture located between the first end and the second end, and closer to the first end than the second end, the blade portion having a slot therein, the slot closed proximate the tip portion, the slot arranged parallel to the cutting edge of the static blade member, the slot arranged to extend leftwardly and rightwardly of the aperture.

13 Claims, 6 Drawing Sheets

(56) References Cited

U.S. PATENT DOCUMENTS

| | | | | |
|---|---|---|---|---|
| 3,054,180 | A | 9/1962 | Gore | |
| D207,388 | S | 4/1967 | Tayler | |
| 3,453,651 | A | 7/1969 | Wertepny | |
| 4,665,615 | A | 5/1987 | Martinez | |
| 4,805,305 | A | 2/1989 | Davis | |
| 5,220,728 | A | 6/1993 | Ueno et al. | |
| 6,092,288 | A | 7/2000 | Adachi | |
| D496,129 | S | 9/2004 | Ogi | |
| 9,724,835 | B2 * | 8/2017 | Soucie et al. | B26B 13/20 |
| 10,478,979 | B1 * | 11/2019 | James | B26B 13/20 |
| 2002/0129497 | A1 * | 9/2002 | Lyddon et al. | B26B 13/20 30/232 |
| 2005/0204569 | A1 * | 9/2005 | Brenton | B26B 13/20 30/323 |
| 2007/0124942 | A1 * | 6/2007 | Nenadich et al. | B26B 13/285 30/266 |
| 2007/0209214 | A1 | 9/2007 | Kamemura et al. | |
| 2008/0172886 | A1 * | 7/2008 | Jun | B26B 13/20 30/232 |
| 2009/0044411 | A1 * | 2/2009 | Cotant | B26B 13/24 30/233.5 |
| 2009/0158598 | A1 * | 6/2009 | Ishida | B26B 13/20 30/232 |
| 2010/0242289 | A1 * | 9/2010 | Roskam et al. | B26B 13/20 30/232 |
| 2010/0293792 | A1 * | 11/2010 | Ishida | B26B 13/20 30/232 |
| 2013/0081282 | A1 * | 4/2013 | Soucie et al. | B26B 13/20 30/232 |
| 2019/0134832 | A1 * | 5/2019 | Smith | B26B 13/24 |

FOREIGN PATENT DOCUMENTS

| | | | | |
|---|---|---|---|---|
| GB | 296901 | * | 9/1928 | B26B 13/24 |
| WO | WO 2007/133567 | * | 11/2007 | B26B 13/20 |

* cited by examiner

SCISSORS WITH REMOVABLE FEATHER RAZOR

FIELD OF THE INVENTION

The present invention relates to hair styling scissors to aid hair stylists in cutting and styling hair in a more efficient manner.

BACKGROUND OF THE INVENTION

For many hair stylists, success comes not only from the quality of the work, but also from the speed at which they provide their service. The more customers a stylist or hairdresser can service in a given day, the more revenue they can earn. However, the introduction of new technology has caused hair styles to become more complex, requiring stylists to become familiar with new technologies to accommodate any requested style. This creates a problem. For a stylist to be successful, he or she must learn how to use these tools in the most efficient way possible.

One tool that has become more and more popular over the years is the feather razor. A feather razor is used to give hair more volume. It does so by layering the hair and taking away unwanted weight in the hair so that it does not lay flat to the head. Almost every hair stylist has a feather razor and uses it regularly. Depending on the style of haircut requested, the hair stylist may have to switch between his or her scissors and the feather razor countless times throughout the cut. Switching back and forth, while trying to maintain efficiency, can cause injuries to the stylist and the customer, and add unnecessary time to the service, necessarily reducing the potential revenue a stylist can earn during a single work-day.

In U.S. Pat. No. 4,805,305 a combination razor and scissor device is disclosed. A first jaw of a pair of scissors comprises a recess for securing a razor. This combination device eliminates the need for a stylist to have a separate razor and pair of scissors. A problem with this particular device, however, is that the razor cartridge is inserted proximate the sharp point of the blades, risking injury. Another problem with this prior art device is that a stylist can only use the razor of the device with the scissors in an open position, which further increases the risk of injury.

Hair trimming razors are known in the art. These razors have finger rings on the rear or other portions of the handle as disclosed in U.S. Pat. No. 6,092,288. A problem with this particular device, however, is that the razor cartridge is inserted proximate the sharp point of the blades, risking injury.

U.S. Published Patent Application No. 2007/0209214 discloses a combination hair tool that comprises a scissor and a razor. The combination hair tool comprises two scissor blade portions operatively arranged to be pivotably connected, wherein one of the scissor blade portions includes a fixedly secured razorblade holder including a blade holder slot, a handle portion, and a finger ring. The combination tool razor blade scissor portion accepts a slideably secured razor blade from the opposite end of the finger ring towards the pivoting connection. A problem with this particular device, however, is that the razor cartridge is inserted proximate the sharp point of the blades, risking injury.

Thus, there is a long felt need for a pair of scissors with a removable feather razor that allows a hair stylist to cut hair with scissors and style hair with a feather razor in a single tool, safetly securing the razor, while allowing a stylist to adjust a rotatably secured finger loop. There is also a long-felt need for a pair of scissors with a removable feather razor held in a cartridge, which cartridge is installable into the scissor blade from the finger ring part of the scissors.

SUMMARY OF THE INVENTION

The present invention broadly comprises a scissors with removable razor cartridge, having a static blade member having a blade portion, the blade portion having a tip at a first end and a handle portion at a second end, wherein the blade portion has a cutting edge and a back edge and the handle portion has a static neck portion and a static finger ring extending therefrom, the back edge extending from the tip and terminating at the static neck portion, the blade portion also having an aperture to accommodate a tension screw, the aperture located between the first end and the second end, and closer to the first end than the second end, the blade portion having a slot arranged within the back edge thereof, the slot closed proximate the tip and open proximate the neck portion and arranged to extend leftwardly and rightwardly of the aperture, the slot releasably holds a removable razor cartridge, a dynamic blade member having a blade portion, the blade portion having a tip at a first end and a handle portion at a second end, wherein the blade portion has a cutting edge and a back edge and the handle portion has a dynamic neck portion and a dynamic finger ring extending therefrom, the blade portion also having an aperture to accommodate the tension screw, the aperture located between the first end of the dynamic blade member and the second end of the dynamic blade member, and closer to the first end than the second end, and a tension screw that passes through both the aperture of the static blade member and the aperture of the dynamic blade member to hold the static blade member and the dynamic blade member in close proximity to one another and form a pivot point about which both the static blade member and the dynamic blade member are operatively arranged to pivot relative to one another.

A general object of the invention is to provide an adjustable and removeable blade and scissor device that allows a stylist to use a feather razor and scissor simultaneously.

A secondary object of the invention is to provide a pair of scissors with a removeable razor blade, which blade is held in a cartridge, and which cartridge is insertable into one of the blades of the scissors from the end of the scissors closest to the finger rings.

A further object of the invention is to provide a combination scissors/feather razor blade assembly wherein the pair of scissors includes a pivot point about which the pair of scissor blades pivot, and wherein a cartridge containing the feather razor overlaps or straddles the pivot point to achieve an optimally balanced pair of scissors.

These and other objects of the invention will become apparent upon review of the following detailed description of the invention in view of the drawings and appended claims.

BRIEF DESCRIPTION OF THE DRAWINGS

The nature and mode of the operation of the present invention will now be more fully described in the following detailed description of the invention taken with the accompanying drawing figures, in which.

DETAILED DESCRIPTION OF THE INVENTION

The terminology used herein is for the purpose of describing particular embodiments only and is not intended to be limiting of the invention.

As used herein, the term "and/or" includes any and all combinations of one or more of the associated listed items. As used herein, the singular forms "a," "an," and "the" are intended to include the plural forms as well as the singular forms, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques.

Accordingly, for the sake of clarity, this description will refrain from repeating every possible combination of the individual steps in an unnecessary fashion.

Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art, that the present invention may be practiced without these specific details.

The present disclosure is to be considered as an exemplification of the invention, and is not intended to limit the invention to the specific embodiments illustrated by the figures or description below.

Figure 1:
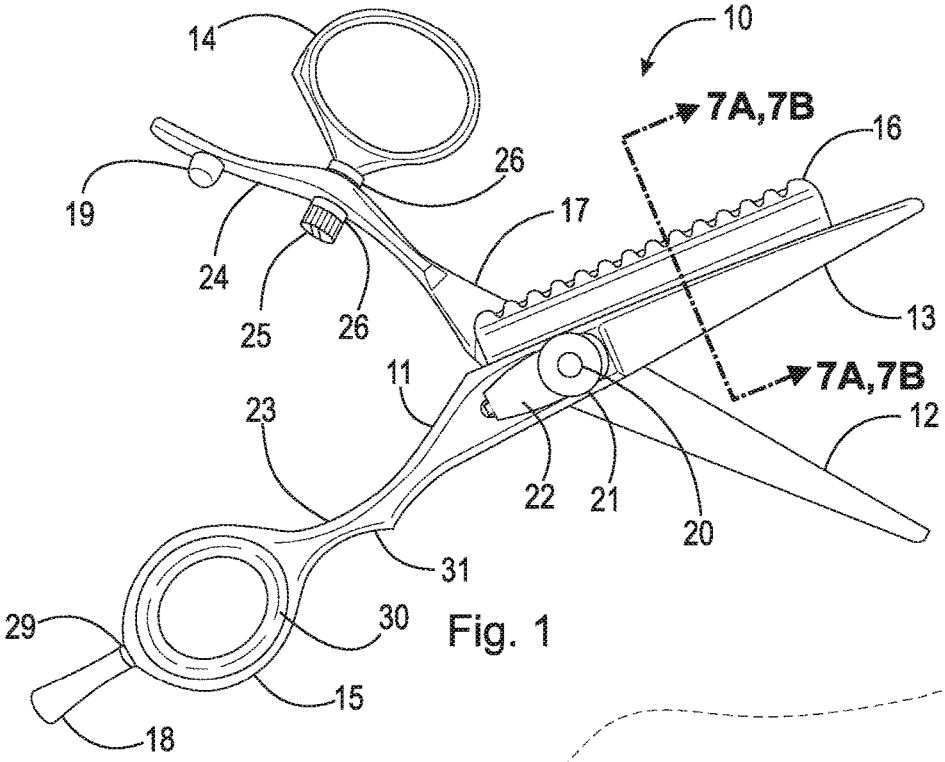
FIG. 1 is a left side view of the present invention in an open position.

The present invention will now be described by referencing the appended figures. The following description should be read in view of FIGS. 1-6. FIG. 1 is a right-side view of the scissor and removable feather razor in an open position. Scissor razor combination 10 broadly comprises dynamic blade member 17, static blade member 11, and removeable razor cartridge 16. Dynamic blade member 17 and static blade member 11 are pivotably attached by way of tension screw 20 that is secured by lock nut 21 and tab 22, discussed further infra.

Dynamic blade member 17 further comprises dynamic blade cutting edge 12, dynamic blade member neck 24, dynamic finger ring 14, and bumper 19. Dynamic finger ring 14 is threadably secured to dynamic blade member neck 24 by finger ring tension screw 25 and spacers 26. Bumper 19 is threadably secured to dynamic blade member neck 24.

Static blade member 11 further comprises static blade cutting edge 13, static blade member neck 23, removable razor cartridge 16, static finger ring 15, rubber finger guard 30, finger rest 18, neck finger rest 31, and slot 50 (shown in FIGS. 7A-8), discussed further infra. Finger rest 18 is threadably secured to static finger ring 15 and has finger rest washer 29 arranged on a male threaded member.

Figure 2:
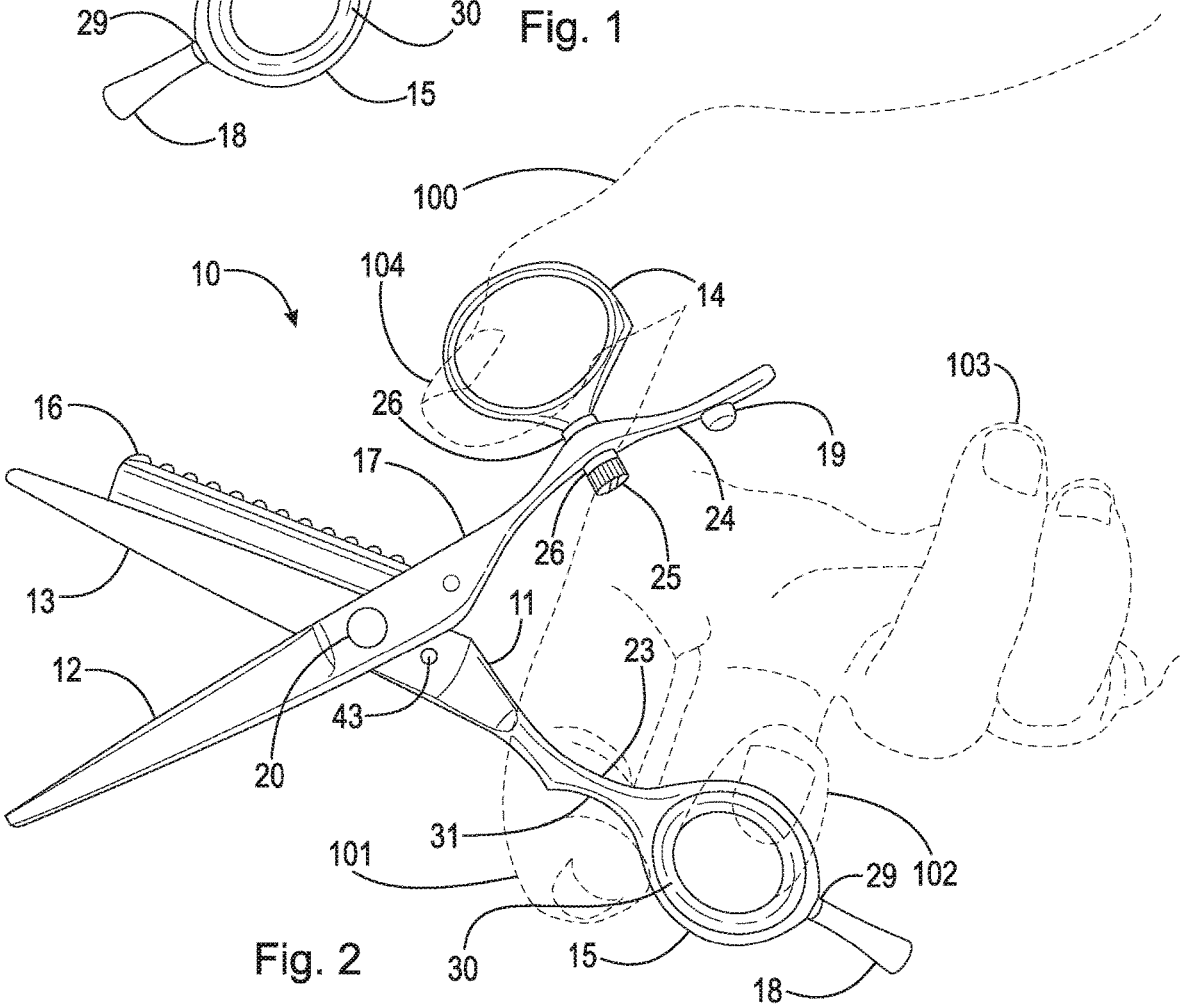
FIG. 2 is a right-side view of the invention in FIG. 1 in an open position showing a user holding the invention.

FIG. 2 is a left side view of scissor razor combination 10 with user right hand 100 holding the invention for use. FIG. 2 is further described infra.

Figure 3:
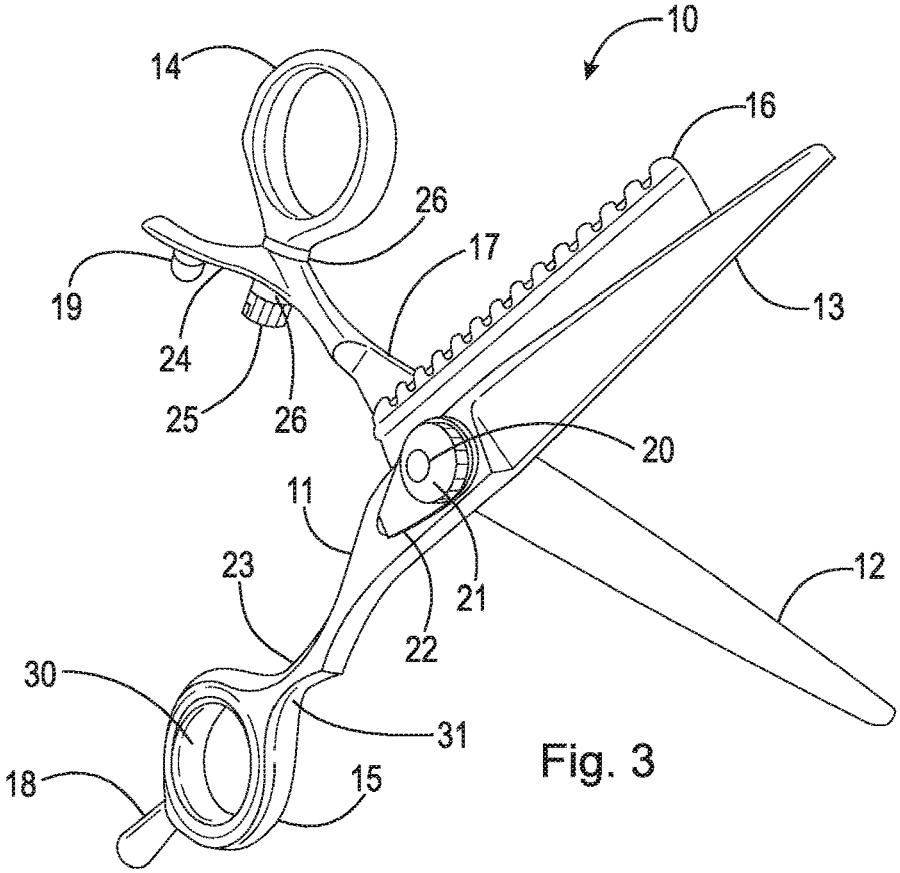
FIG. 3 is a left-front perspective view of the invention in FIG. 1 in an open position.

FIG. 3 is a right-front perspective view of scissor razor combination 10 in an open position.

Figure 4:
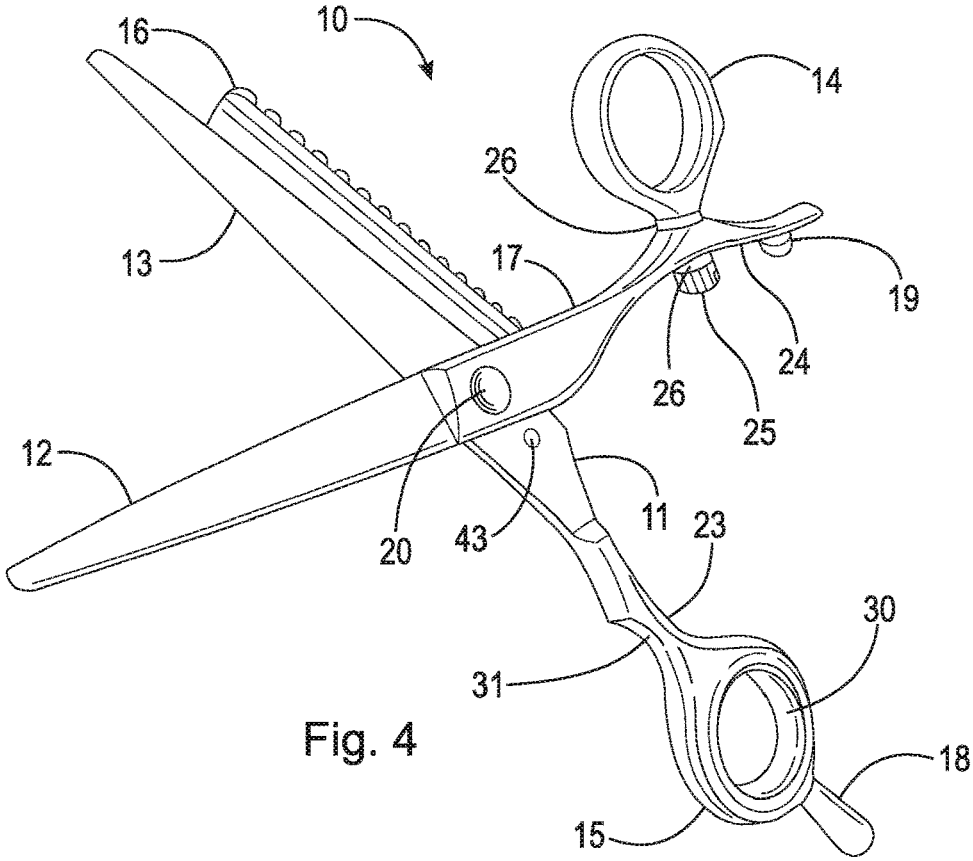
FIG. 4 is a right-front perspective view of the invention in FIG. 1 in an open position.

FIG. 4 is a left-front perspective view of scissor razor combination 10 in an open position.

Figure 9:
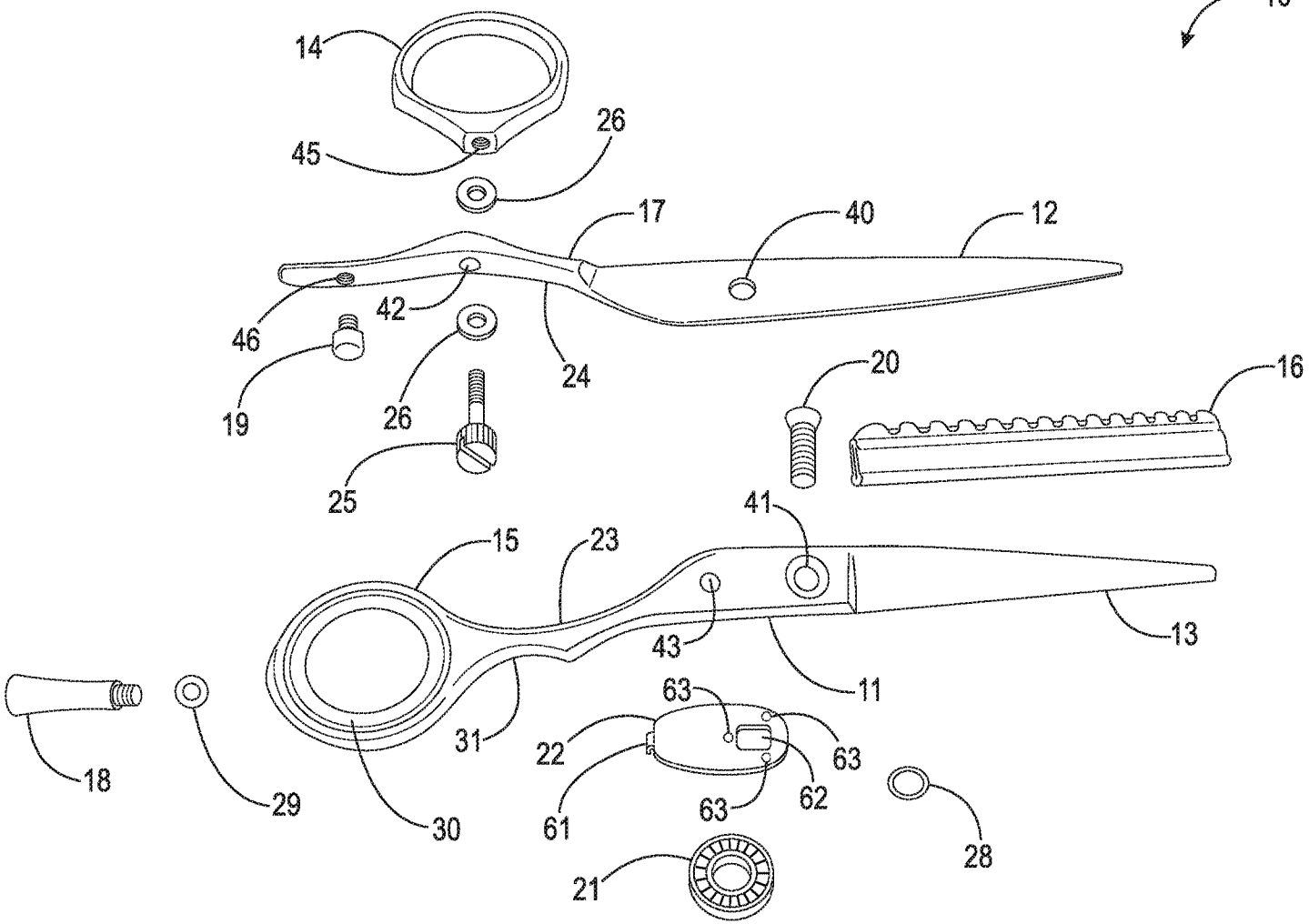

The following description should be read in view of FIGS. 3-4 and FIG. 9. Blade member tension screw 20 rotatably secures dynamic blade member 17 and static blade member 11 through substantially centered dynamic blade member aperture 40 and substantially centered static blade member aperture 41. Static blade member aperture 41 is countersunk and operatively arranged to accept cone washer 28. Tab 22 comprises tab hook 61, tab aperture 62, and protrusions 63. The tab aperture 62 of tab 22 is operatively arranged to accept tension screw 20. Tension screw 20 is secured by lock nut 21. Lock nut 21 comprises a plurality of ridges operatively arranged to contact and frictionally secure lock nut 21 to protrusions 63 on the surface of tab 22. Tab aperture 62 is operatively arranged to accept tab hook 61 to prevent rotation when threadably secured by tension screw 20 and lock nut 21. Hook aperture 43 may also be a depression operatively arranged to accept tab hook 61 of tab 22.

Figure 5:
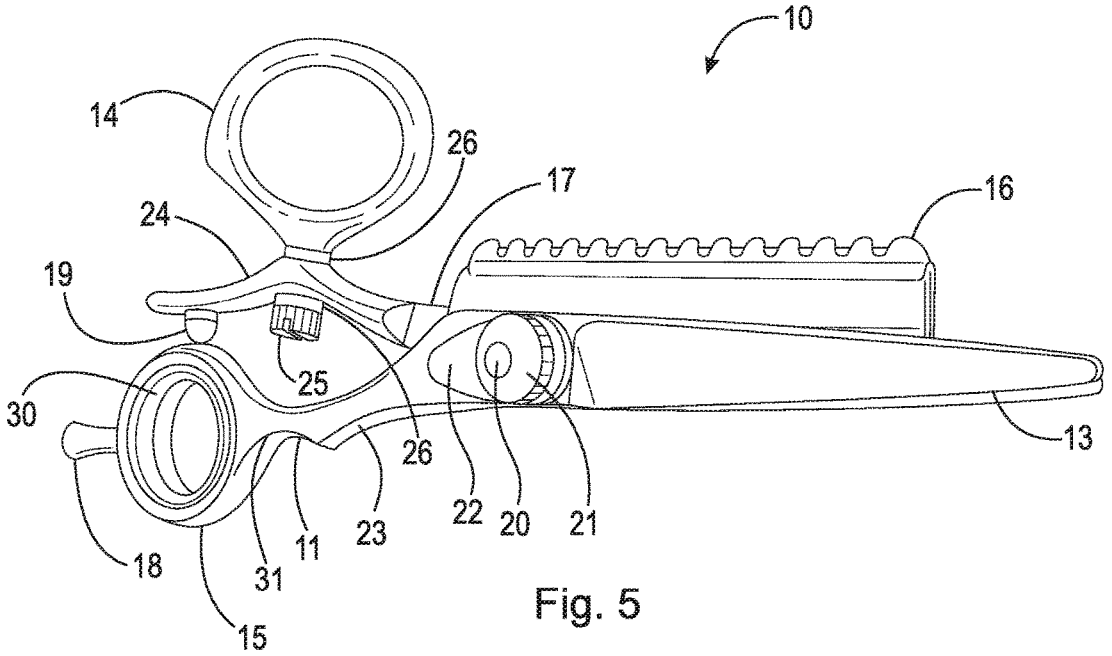
FIG. 5 is a left-front perspective view of the invention in FIG. 1 in a closed position.
Figure 6:
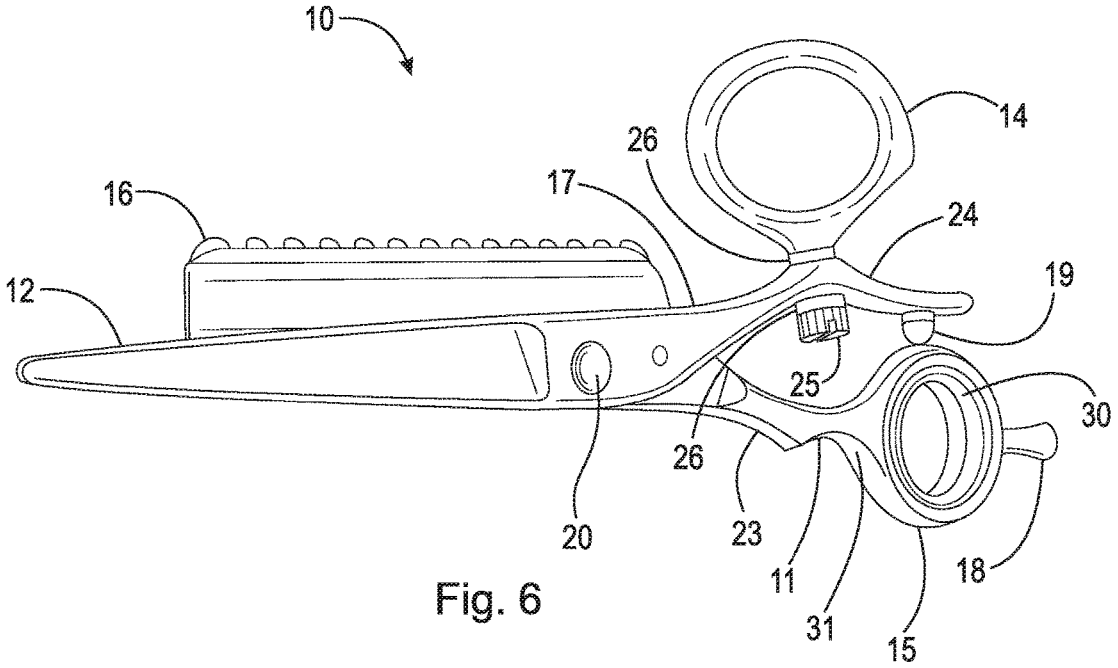
FIG. 6 is a right-front perspective view of the invention in FIG. 1 in a closed position.

The following description should be read in view of FIG. 5 and FIG. 6. FIG. 5 is a left-front perspective view of scissor razor combination 10 in a closed position. FIG. 6 is a right-front perspective view of scissor razor combination 10 in a closed position. Bumper 19 is operatively arranged to contact outer surface of static finger ring 15. Bumper 19 prevents scissor razor combination 10 from closing further to prevent snagging hair if the respective blades were to pass the range restriction created by bumper 19. Bumper 19 also provides a user feedback as a bumper contacts the surface of static finger ring 15.

Figure 7A:
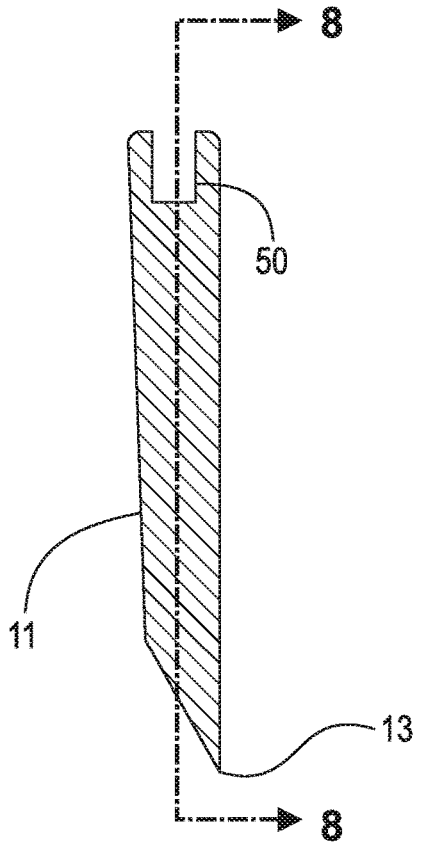
FIG. 7A is a cross-sectional view of the invention's static blade member without a removable razor cartridge in place, which view is taken generally along line 7A shown in FIG. 1.
Figure 7B:
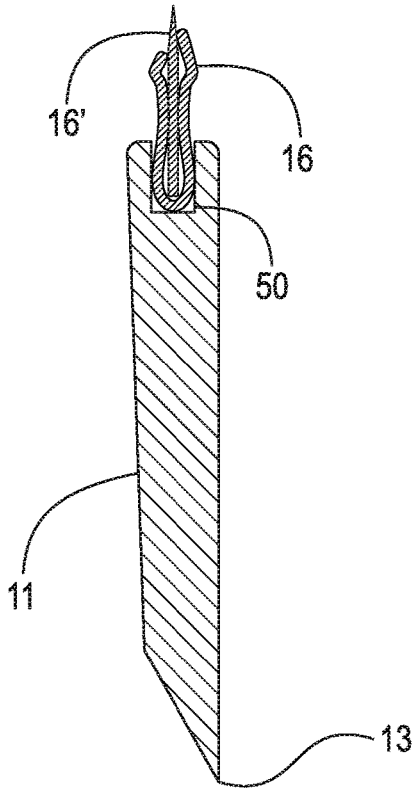
FIG. 7B is a cross-sectional view of the invention's static blade member with a removable razor cartridge installed therein, which view is taken generally along line 7B-7B shown in FIG. 1.
Figure 8:
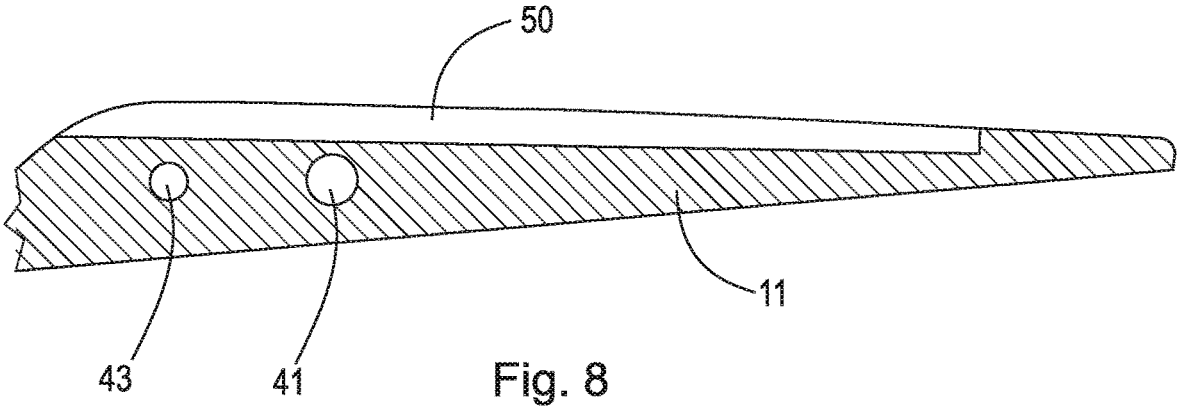
FIG. 8 is a fragmentary cross-sectional view of the invention's static blade member, which view is taken generally along line 8-8 in FIG. 7A; and, FIG. 9 is an exploded view of the invention shown in FIG. 1.

Diverting to FIGS. 7A-8: FIG. 7A shows a cross-sectional front view of static blade member 11 cut along line 7A shown in FIG. 1 without removable razor cartridge 16; FIG. 7B shows a cross-sectional front view of static blade member 11 cut along line 7B shown in FIG. 1 with removable razor cartridge 16 in place in slot 50; FIG. 8 shows a partial left side view of static blade member 11 cut along line 8 shown in FIG. 7A with razor cartridge 16 removed from slot 50. The following description should be read in view of all Figures. Removable razor cartridge 16 holds razor blade 16'. Removable razor slot 50 is centrally disposed in static blade member 11 within the opposite surface of static blade member cutting edge 13. Removable razor cartridge 16 is frictionally secured within removable razor slot 50 by outwardly pushing edges that contact the inner surfaces of removable razor slot 50. Removable razor slot 50 terminates before the tip of static blade member 11 as shown in FIG. 8. Removable razor cartridge 16 substantially straddles the pivot point at tension screw 20 at dynamic blade aperture 40 and static blade aperture 41. Removable razor cartridge 16 is slideably inserted into removable razor slot 50 at the static blade member neck 23 end of slot 50 and slid towards static blade member cutting edge 13 end of slot 50. Removable razor slot 50 extends in length in a direction opposite of the tip of static blade member 11. The length of removable razor slot 50, in the direction opposite static blade member 11 tip and in the direction of hook aperture 43, is shorter than the length of removable razor slot 50 that extends in the direction of static blade member 11 towards the tip, relative to static blade member aperture 41, as illustrated in FIG. 8.

Diverting back to FIG. 2; FIG. 2 shows scissor razor combination 10 held in right hand 100. Dynamic finger ring 14 is operatively arranged to access thumb 104 to hold dynamic blade member 17. Dynamic finger ring 14 is rotatably adjustable to accommodate thumb 104 resting within to the most ideal and comfortable position for a user, reducing fatigue that fixed thumb rings may cause. Static finger ring 15 is operatively arranged to accept middle finger 102. Static finger ring comprises inner finger guard 30 to protect middle finger 102 from sustained use, reducing fatigue from continual use. Neck finger rest 31 is operatively arranged to provide a contoured and ergonomic surface for index finger 101 to rest. Static blade member 11 also includes finger rest 18 that is operatively arranged to optionally allow ring finger 103 to also rest thereon, further improving comfort for a user over prolonged use.

Figure 10:
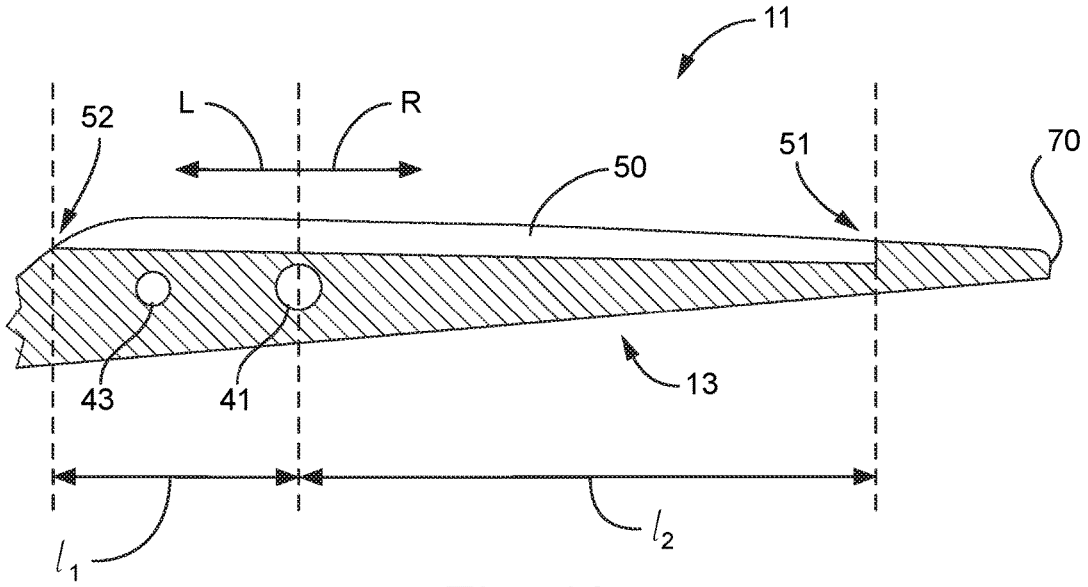
FIG. 10 is the fragmentary cross-sectional view of the invention's static blade member shown in FIG. 8; and, FIG. 11 is a left side view of the invention's static blade member.

FIG. 10 illustrates the fragmentary cross-sectional view of static blade member 11 shown in FIG. 8. Slot 50 includes closed end 51 and open end 52. Slot 50 is further arranged to extend in leftward direction L relative to static blade member aperture 41 and to extend in rightward direction R relative to static blade member aperture 41. Slot 50 extends in leftward direction L a length $L_1$ towards open end 52, terminating slot 50 thereat. Slot 50 extends in rightward direction R a length $L_2$ towards closed end 51, terminating slot 50 thereat. Length $L_1$ is less than length $L_2$.

Figure 11:
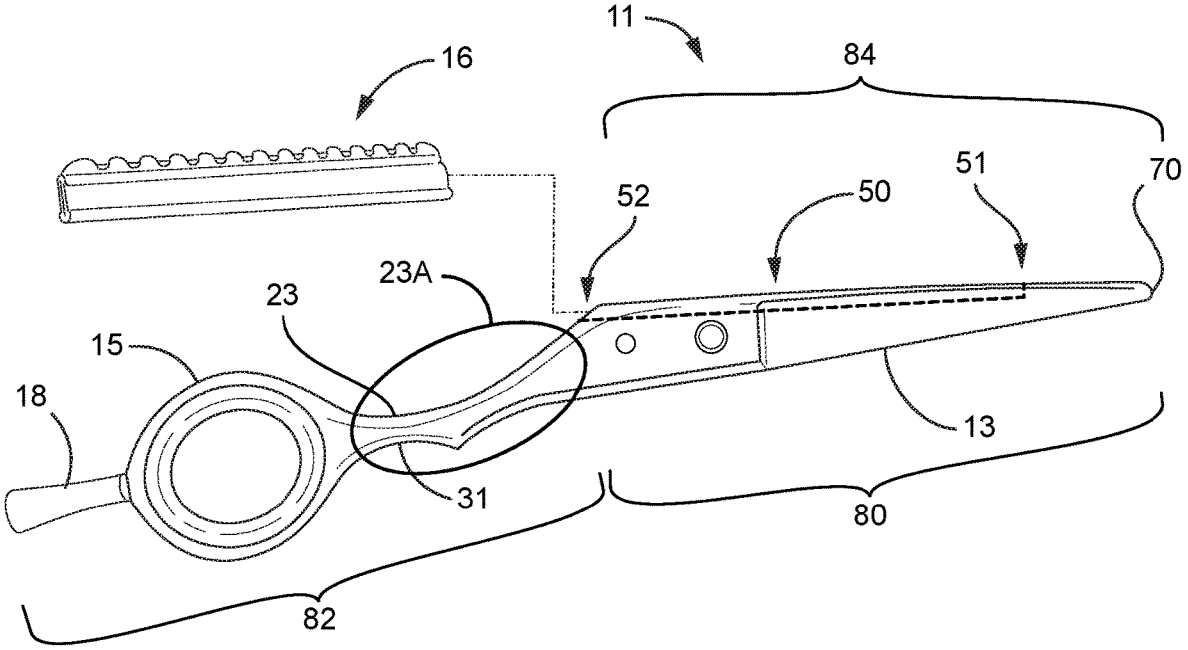

FIG. 11 illustrates a left side view of static blade member 11, specifically illustrating removable razor cartridge 16 disengaged with slot 50, whereas slot 50 is illustrated in broken lines. Static blade member 11 in a preferred embodiment includes blade portion 80 having cutting edge 13, tip 70, and, back edge 84. Back edge 84 is arranged on the opposite side of cutting edge 13. Extending from back edge 84 and cutting edge 13 is neck portion 23A. Neck portion 23A is defined by the section between open end 52 of slot 50 and static finger ring 15 within handle portion 82, specifically including neck 23 and neck finger rest 31. Handle portion 82 includes neck portion 23A, neck 23, neck finger rest 31, specifically neck finger rest 31 is located on the same side as cutting edge 13. Handle portion 82 also includes static finger ring 15 and finger rest 18. As described supra, handle portion 82 is defined by the components that engage fingers 101, 102, and 103 of right hand 100, as shown in FIG. 2. Removable razor cartridge 16 is arranged to be slid into slot 50 from open end 52 in the direction towards closed end 51, engaging slot 50 as illustrated in FIG. 7B. This configuration eliminates the risk of injury related to a razor cartridge being inserted proximate a sharp tip of a blade member.

To use removable razor 16, scissor razor combination 10 is moved to a closed position shown in FIGS. 5 and 6. A user would comb a section or layer of hair and pull removable razor 16 up or down that section or layer to create a textured or feathered look.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMBERS

10 scissor/razor combination
11 static blade member
12 dynamic blade cutting edge
13 static blade cutting edge
14 dynamic finger ring
15 static finger ring
16' razor blade
16 removable razor cartridge
17 dynamic blade member
18 finger rest
19 threaded bumper
20 blade member tension screw
21 lock nut
22 tab
23 static blade member neck
23A neck portion of static blade 11
24 dynamic blade member neck
25 finger ring tension screw
26 spacer
28 cone washer
29 finger rest washer
30 finger guard
31 neck finger rest
40 dynamic blade member aperture
41 static blade member aperture
42 finger ring aperture
43 hook aperture
44 finger rest aperture
45 threaded bumper aperture
46 threaded finger ring aperture
50 slot
51 closed end of slot 50
52 open end of slot 50
61 tab hook
62 aperture
63 frictional bumps
70 tip of static blade member 11
80 blade portion of static blade member 11
82 handle portion of static blade member 11
84 back edge of static blade member 11
L leftward direction
R rightward direction
$L_1$ length
$L_2$ length

The invention claimed is:

1. A scissors with removable razor cartridge, comprising:

a static blade member having a blade portion, said blade portion having a tip at a first end and a handle portion at a second end, wherein said blade portion has a cutting edge and a back edge and said handle portion has a static neck portion and a static finger ring extending therefrom, said back edge extending from said tip and terminating at said static neck portion, said blade portion also having an aperture to accommodate a tension screw, said aperture located between said first end and said second end, and closer to said first end than said second end, said blade portion having a slot arranged within said back edge thereof, said slot closed proximate said tip and open proximate said neck portion and arranged to extend leftwardly and rightwardly of said aperture, said slot releasably holds said removable razor cartridge therein;

a dynamic blade member having a blade portion, said blade portion having a tip at a first end and a handle portion at a second end, wherein said blade portion has a cutting edge and a back edge and said handle portion has a dynamic neck portion and a dynamic finger ring extending therefrom, said blade portion also having an aperture to accommodate said tension screw, said aperture located between said first end of said dynamic blade member and said second end of said dynamic blade member, and closer to said first end than said second end; and, a tension screw that passes through both said aperture of said static blade member and said aperture of said dynamic blade member to hold said static blade member and said dynamic blade member in close proximity to one another and form a pivot point about which both said static blade member and said dynamic blade member are operatively arranged to pivot relative to one another.

2. The scissors with removable razor cartridge recited in claim 1 wherein said static neck portion of said static blade member includes a finger rest extending outwardly from said finger ring of said static blade member.

3. The scissors with removable razor cartridge recited in claim 1 wherein said dynamic finger ring is operatively arranged to swivel.

4. The scissors with removable razor cartridge recited in claim 1, wherein said removable razor cartridge is arranged to hold a razor blade.

5. The scissors with removable razor cartridge recited in claim 1, wherein said dynamic blade member and said static blade member are made of steel.

6. The scissors with removable razor cartridge recited in claim 1, wherein said dynamic blade member and said static blade member are made of aluminum.

7. The scissors with removable razor cartridge recited in claim 1, wherein said static blade member and said dynamic blade member are rotatably secured by said tension screw and a lock nut, wherein a tab is sandwiched between said lock nut and said static blade member.

8. The scissors with removable razor cartridge in claim 7 wherein said tab further comprises:

a hook;

a plurality of frictional bumps;

a tab aperture centrally arranged on said tab, wherein said tab aperture accepts said tension screw therein; and, said hook is fit within a hook aperture of said static blade member, said hook aperture is arranged adjacent to said aperture of said blade portion of said static blade member.

9. The scissors with removable razor cartridge recited in claim 1 further comprising a rubber guard, operatively arranged about an inner surface of said finger ring on said static blade member.

10. The scissors with removable razor cartridge recited in claim 1 wherein said dynamic neck portion comprises a bumper threadably secured thereto.

11. A static blade member for a scissors with a removable razor cartridge, said static blade member comprising a blade portion, said blade portion having a back edge extending from a tip of said blade portion to a neck portion of said static blade member, said neck portion arranged opposite of said tip; and, a slot arranged within said back edge, said slot having an open end and a closed end, said open end of said slot is arranged proximate to said neck portion, said closed end of said slot is arranged proximate to said tip of said blade portion, wherein said slot is arranged to accept a removable razor cartridge at said open end, said slot further arranged to releasably hold said removable razor cartridge therein.

12. The static blade member for a scissors with removable razor cartridge recited in claim 11, wherein said blade portion of said static blade member further comprises an aperture therein, said aperture arranged proximate to said neck portion, wherein said slot is further arranged to extend a first length relative to said aperture towards said open end, said slot is arranged to extend a second length relative to said aperture towards said closed end, and said second length of said slot is greater than said first length of said slot.

13. A scissors comprising:

the static blade member recited in claim 12, and a dynamic blade member, said dynamic blade member having a blade portion, said blade portion of said dynamic blade member having an aperture arranged therein, said dynamic blade member having a neck extending from said blade portion, said neck arranged oppositely from a tip of said blade portion, and said neck having a dynamic finger ring rotatably secured thereon, wherein said aperture of said static blade member and said aperture of said blade portion of said dynamic blade member both accept a tension screw therein, said tension screw rotatably secures said dynamic blade member and said static blade member to one another.

* * * * *